US011788739B2

(12) United States Patent
Goel et al.

(10) Patent No.: US 11,788,739 B2
(45) Date of Patent: Oct. 17, 2023

(54) METHOD AND APPARATUS FOR HYBRID DEHUMIDIFICATION

(71) Applicant: Lennox Industries Inc., Richardson, TX (US)

(72) Inventors: Rakesh Goel, Irving, TX (US); John N. Tran, The Colony, TX (US)

(73) Assignee: Lennox Industries Inc., Richardson, TX (US)

( * ) Notice: Subject to any disclaimer, the term of this patent is extended or adjusted under 35 U.S.C. 154(b) by 37 days.

(21) Appl. No.: 17/197,215

(22) Filed: Mar. 10, 2021

(65) Prior Publication Data

US 2021/0190396 A1 Jun. 24, 2021

Related U.S. Application Data

(63) Continuation of application No. 15/948,049, filed on Apr. 9, 2018, now Pat. No. 10,969,145.

(51) Int. Cl.
*F25B 39/02* (2006.01)
*F24F 3/14* (2006.01)
(Continued)

(52) U.S. Cl.
CPC ..... *F24F 3/1405* (2013.01); *F24F 11/52* (2018.01); *F24F 11/65* (2018.01); *F24F 11/84* (2018.01);
(Continued)

(58) Field of Classification Search
CPC ..... F25B 5/02; F25B 39/02; F25B 39/028; F25B 41/003; F25B 41/22; F25B 41/24; F25B 2600/2511; F25B 2700/02; F24F 1/0083; F24F 11/84; F24F 2110/20; F24F 2110/22
See application file for complete search history.

(56) References Cited

U.S. PATENT DOCUMENTS 3,977,205 A 8/1976 Dreisziger et al.
4,938,032 A 7/1990 Mudford
(Continued)

FOREIGN PATENT DOCUMENTS

CA 2968798 A1 12/2017
CN 106052200 A 10/2016
(Continued)

OTHER PUBLICATIONS

U.S. Appl. No. 15/948,102, Goel et al.
U.S. Appl. No. 15/948,049, Goel et al.

*Primary Examiner* — Jonathan Bradford
(74) *Attorney, Agent, or Firm* — Bradley Arant Boult Cummings

(57) ABSTRACT

An evaporator coil system includes a segmented evaporator coil. The segmented evaporator coil includes a primary segment and a secondary segment. A first plurality of evaporator circuit lines are fluidly coupled to the primary segment and a second plurality of evaporator circuit lines are fluidly coupled to the secondary segment. A suction line includes a first connection fluidly coupled to the primary segment and a second connection fluidly coupled to the secondary segment. A valve is arranged in fluid communication with the secondary segment so as to selectively restrict refrigerant flow through the secondary segment.

16 Claims, 4 Drawing Sheets

(51) Int. Cl.

| | |
|---|---|
| ***F24F 11/52*** | (2018.01) |
| ***F24F 11/65*** | (2018.01) |
| ***F24F 11/84*** | (2018.01) |
| ***F25B 41/22*** | (2021.01) |
| ***F25B 49/02*** | (2006.01) |
| ***F25B 41/24*** | (2021.01) |
| *F24F 110/10* | (2018.01) |
| *F24F 110/20* | (2018.01) |
| *F25B 41/42* | (2021.01) |
| *F24F 1/0083* | (2019.01) |

(52) U.S. Cl.

CPC ..... *F25B 39/02* (2013.01); *F25B 39/028* (2013.01); *F25B 41/22* (2021.01); *F25B 41/24* (2021.01); *F25B 49/02* (2013.01); *F24F 1/0083* (2019.02); *F24F 2110/10* (2018.01); *F24F 2110/20* (2018.01); *F25B 41/42* (2021.01); *F25B 2339/02* (2013.01); *F25B 2600/2511* (2013.01); *F25B 2600/2515* (2013.01); *F25B 2700/02* (2013.01)

(56) References Cited

U.S. PATENT DOCUMENTS

| | | | | |
|---|---|---|---|---|
| 6,023,940 | A | 2/2000 | Abbott et al. | |
| 6,026,654 | A | 2/2000 | Park | |
| 6,138,919 | A * | 10/2000 | Cooper | F25B 5/02 62/199 |
| 6,338,254 | B1 | 1/2002 | Alsenz | |
| 6,381,974 | B1 | 5/2002 | Hwang et al. | |
| 7,770,405 | B1 | 8/2010 | Dillon | |
| 9,599,353 | B2 | 3/2017 | Cur et al. | |
| 2006/0288713 | A1 | 12/2006 | Knight et al. | |
| 2008/0302112 | A1 | 12/2008 | Anderson et al. | |
| 2012/0227426 | A1 * | 9/2012 | Deaconu | F25B 41/39 62/126 |
| 2014/0041402 | A1 | 2/2014 | Thogersen et al. | |
| 2014/0311172 | A1 | 10/2014 | Iwasaki | |
| 2015/0013356 | A1 | 1/2015 | Karkhanis et al. | |
| 2015/0083378 | A1 | 3/2015 | Banach | |
| 2016/0178222 | A1 | 6/2016 | Bush et al. | |
| 2016/0334129 | A1 | 11/2016 | Shinoda et al. | |
| 2017/0153037 | A1 | 6/2017 | Goel et al. | |
| 2018/0094841 | A1 | 4/2018 | Kester et al. | |

FOREIGN PATENT DOCUMENTS

| | | | |
|---|---|---|---|
| CN | 106642831 | A | 5/2017 |
| WO | WO-2015083378 | A1 | 6/2015 |

* cited by examiner

METHOD AND APPARATUS FOR HYBRID DEHUMIDIFICATION

CROSS-REFERENCE TO RELATED APPLICATION

This application is a continuation of U.S. patent application Ser. No. 15/948,049, filed on Apr. 9, 2018. U.S. patent application Ser. No. 15/948,049 is incorporated herein by reference.

TECHNICAL FIELD

The present disclosure relates generally to heating, ventilation, and air conditioning (HVAC) equipment and applications and more particularly, but not by way of limitation, to use of a segmented evaporator to improve latent capacity of an HVAC system.

BACKGROUND

This section provides background information to facilitate a better understanding of the various aspects of the disclosure. It should be understood that the statements in this section of this document are to be read in this light, and not as admissions of prior art.

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air). To direct operation of the circulation fan and other components, HVAC systems include a controller. In addition to directing operation of the HVAC system, the controller may be used to monitor various components, (i.e. equipment) of the HVAC system to determine if the components are functioning properly.

SUMMARY

This summary is provided to introduce a selection of concepts that are further described below in the detailed description. This summary is not intended to identify key or essential features of the claimed subject matter, nor is it to be used as an aid in limiting the scope of the claimed subject matter.

In one aspect, the present disclosure relates to an evaporator coil system. The evaporator coil system includes a segmented evaporator coil. The segmented evaporator coil includes a primary segment and a secondary segment. A first plurality of evaporator circuit lines are fluidly coupled to the primary segment and a second plurality of evaporator circuit lines are fluidly coupled to the secondary segment. A suction line includes a first connection fluidly coupled to the primary segment and a second connection fluidly coupled to the secondary segment. A valve is arranged in fluid communication with the secondary segment so as to selectively restrict refrigerant flow through the secondary segment.

In another aspect, the present disclosure relates to a heating, ventilation, and air conditioning ("HVAC") system. The HVAC system includes a condenser coil and a metering device fluidly coupled to the condenser coil. The HVAC system includes a segmented evaporator coil including a primary segment and a secondary segment. The primary segment is fluidly coupled to the metering device via a first plurality of evaporator circuit lines and the secondary segment is fluidly coupled to the metering device via a second plurality of evaporator circuit lines. A compressor is fluidly coupled to the segmented evaporator coil via a suction line. The suction line includes a first connection fluidly coupled to the primary segment and a second connection fluidly coupled to the secondary segment. A valve is arranged in fluid communication with the secondary segment, the valve being movable between an open position and a closed position so as to selectively restrict refrigerant flow through the secondary segment. An HVAC controller is electrically coupled to the valve.

In another aspect, the present disclosure relates to a method of controlling a heating, ventilation, and air-conditioning (HVAC) system to regulate relative humidity. The method includes measuring, via an HVAC controller, an operational time of the HVAC system and determining, via the HVAC controller, if the operational time exceeds a pre-defined run-time threshold. The method includes determining, via the HVAC controller, if a relative humidity of an enclosed space exceeds a pre-defined set point relative humidity. Responsive to a determination that the operational time exceeds the pre-defined run-time threshold and the relative humidity of the enclosed space exceeds the pre-defined set point relative humidity, a valve is signaled to close thereby restricting flow of refrigerant through a secondary segment of an evaporator coil. Responsive to a determination that the operational time does not exceed the pre-defined run-time threshold or the relative humidity of the enclosed space does not exceed the pre-defined set point relative humidity, the valve is signaled to open thereby permitting flow of refrigerant through a secondary segment of an evaporator coil.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
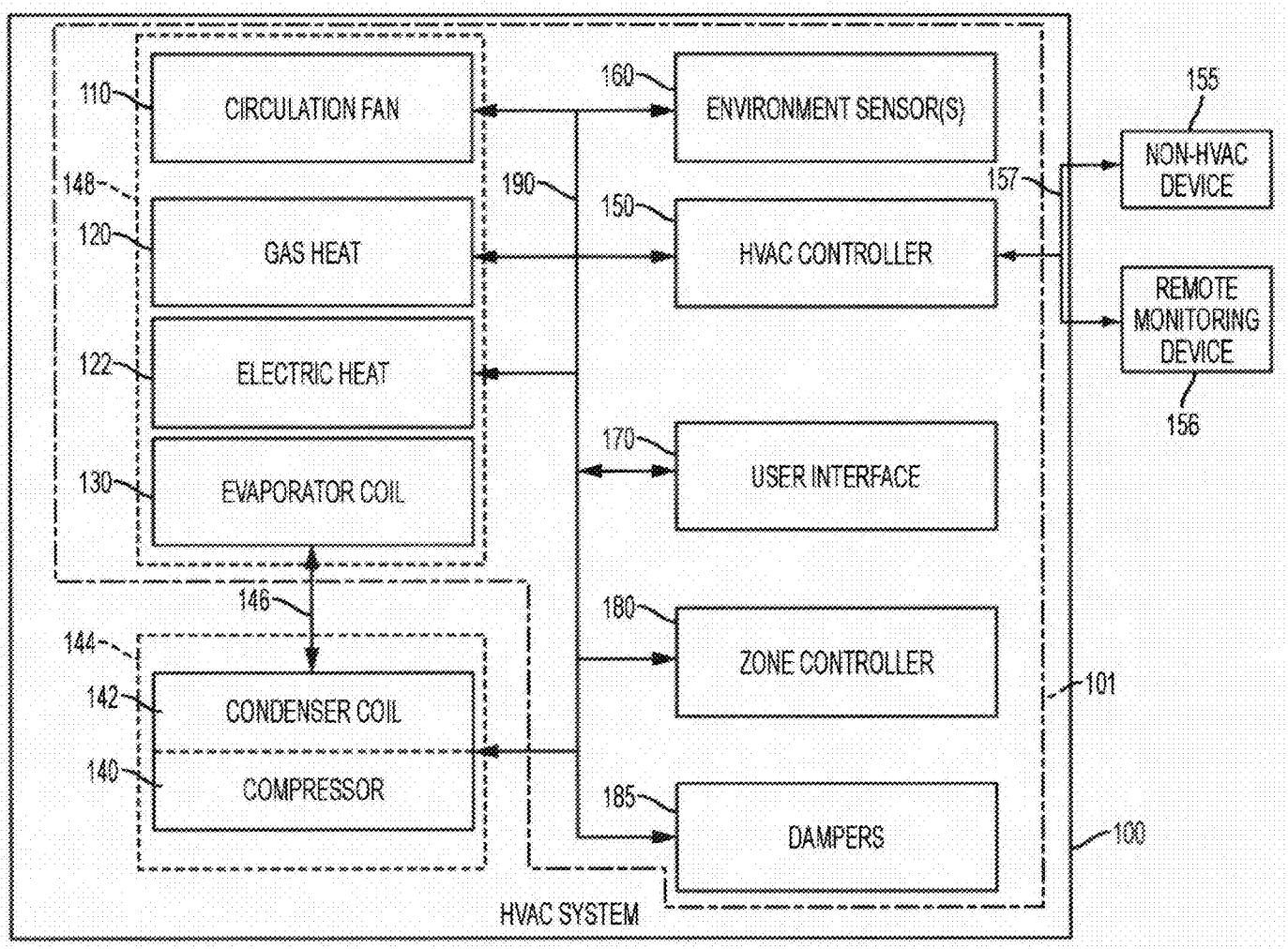
FIG. 1 is a block diagram of an exemplary HVAC system.

Various embodiments will now be described more fully with reference to the accompanying drawings. The disclosure may, however, be embodied in many different forms and should not be construed as limited to the embodiments set forth herein.

HVAC systems are frequently utilized to adjust both temperature of conditioned air as well as relative humidity of the conditioned air. A cooling capacity of an HVAC system is a combination of the HVAC system's sensible cooling capacity and latent cooling capacity. Sensible cooling capacity refers to an ability of the HVAC system to remove sensible heat from conditioned air. Latent cooling capacity refers to an ability of the HVAC system to remove latent heat from conditioned air. Sensible cooling capacity and latent cooling capacity vary with environmental conditions. Sensible heat refers to heat that, when added to or removed from the conditioned air, results in a temperature change of the conditioned air. Latent heat refers to heat that, when added to or removed from the conditioned air, results in a phase change of, for example, water within the conditioned air. Sensible-to-total ratio ("S/T ratio") is a ratio of sensible heat to total heat (sensible heat+latent heat). The lower the S/T ratio, the higher the latent cooling capacity of the HVAC system for given environmental conditions. The S/T ratio is negative in the case of heating.

Sensible cooling load refers to an amount of heat that must be removed from the enclosed space to accomplish a desired temperature change of the air within the enclosed space. The sensible cooling load is reflected by a temperature within the enclosed space as read on a dry-bulb thermometer. Latent cooling load refers to an amount of heat that must be removed from the enclosed space to accomplish a desired change in humidity of the air within the enclosed space. The latent cooling load is reflected by a temperature within the enclosed space as read on a wet-bulb thermometer. Setpoint or temperature setpoint refers to a target temperature setting or relative humidity of the HVAC system as set by a user or automatically based on a pre-defined schedule.

When there is a high sensible cooling load such as, for example, when outside-air temperature is significantly warmer than an inside-air temperature setpoint, the HVAC system will continue to operate in an effort to effectively cool and dehumidify the conditioned air. Such operation of the HVAC system is referred to herein as "cooling mode." When there is a low sensible cooling load but high relative humidity such as, for example, when the outside air temperature is relatively close to the inside air temperature setpoint, but the outside air is considerably more humid than the inside air, supplemental air dehumidification is often undertaken to avoid occupant discomfort. Such operation is referred to herein as "dehumidification mode."

An existing approach to air dehumidification involves lowering the temperature setpoint of the HVAC system. This approach causes the HVAC system to operate for longer periods of time than if the temperature setpoint of the HVAC system were set to a higher temperature. This approach serves to reduce both the temperature and humidity of the conditioned air. However, this approach results in over-cooling of the conditioned air, which over-cooling often results in occupant discomfort. Additionally, consequent extended run times cause the HVAC system to consume more energy, which leads to higher utility costs. Another air dehumidification approach involves re-heating of air leaving an evaporator coil.

FIG. 1 illustrates an HVAC system 100. In various embodiments, the HVAC system 100 is a networked HVAC system that is configured to condition air via, for example, heating, cooling, humidifying, or dehumidifying air within an enclosed space 101. In various embodiments, the enclosed space 101 is, for example, a house, an office building, a warehouse, and the like. Thus, the HVAC system 100 can be a residential system or a commercial system such as, for example, a roof top system. For exemplary illustration, the HVAC system 100 as illustrated in FIG. 1 includes various components; however, in other embodiments, the HVAC system 100 may include additional components that are not illustrated but typically included within HVAC systems.

The HVAC system 100 includes a circulation fan 110, a gas heat 120, electric heat 122 typically associated with the circulation fan 110, and a refrigerant evaporator coil 130, also typically associated with the circulation fan 110. The circulation fan 110, the gas heat 120, the electric heat 122, and the refrigerant evaporator coil 130 are collectively referred to as an "indoor unit" 148. The indoor unit 148 is located within, or in close proximity to, the enclosed space 101. The HVAC system 100 also includes a compressor 140 and an associated condenser coil 142, which are typically referred to as an "outdoor unit" 144. In various embodiments, the outdoor unit 144 is, for example, a rooftop unit or a ground-level unit. The compressor 140 and the associated condenser coil 142 are connected to an associated evaporator coil 130 by a refrigerant line 146. In various embodiments, the compressor 140 is, for example, a single-stage compressor, a multi-stage compressor, a single-speed compressor, or a variable-speed compressor. In various embodiments, the circulation fan 110, sometimes referred to as a blower, may be configured to operate at different capacities (i.e., variable motor speeds) to circulate air through the HVAC system 100, whereby the circulated air is conditioned and supplied to the enclosed space 101.

Still referring to FIG. 1, the HVAC system 100 includes an HVAC controller 150 that is configured to control operation of the various components of the HVAC system 100 such as, for example, the circulation fan 110, the gas heat 120, the electric heat 122, and the compressor 140 to regulate the environment of the enclosed space 101. In some embodiments, the HVAC system 100 can be a zoned system. In such embodiments, the HVAC system 100 includes a zone controller 180, dampers 185, and a plurality of environment sensors 160. In various embodiments, the HVAC controller 150 cooperates with the zone controller 180 and the dampers 185 to regulate the environment of the enclosed space 101.

The HVAC controller 150 may be an integrated controller or a distributed controller that directs operation of the HVAC system 100. In various embodiments, the HVAC controller 150 includes an interface to receive, for example, thermostat calls, temperature setpoints, blower control signals, environmental conditions, and operating mode status for various zones of the HVAC system 100. For example, in various embodiments, the environmental conditions may include indoor temperature and relative humidity of the enclosed space 101. The HVAC controller 150 also includes a processor and a memory to direct operation of the HVAC system 100 including, for example, a speed of the circulation fan 110.

Still referring to FIG. 1, in some embodiments, the plurality of environment sensors 160 are associated with the HVAC controller 150 and also optionally associated with a user interface 170. The plurality of environment sensors 160 provide environmental information within a zone or zones of the enclosed space 101 such as, for example, temperature and humidity of the enclosed space 101 to the HVAC controller 150. The plurality of environment sensors 160 may also send the environmental information to a display of the user interface 170. In some embodiments, the user interface 170 provides additional functions such as, for example, operational, diagnostic, status message display, and a visual interface that allows at least one of an installer, a user, a support entity, and a service provider to perform actions with respect to the HVAC system 100. In some embodiments, the user interface 170 is, for example, a thermostat of the HVAC system 100. In other embodiments, the user interface 170 is associated with at least one sensor of the plurality of environment sensors 160 to determine the environmental condition information and communicate that information to the user. The user interface 170 may also include a display, buttons, a microphone, a speaker, or other components to communicate with the user. Additionally, the user interface 170 may include a processor and memory that is configured to receive user-determined parameters such as, for example, temperature and relative humidity of the enclosed space 101, and calculate operational parameters of the HVAC system 100 as disclosed herein.

In various embodiments, the HVAC system 100 is configured to communicate with a plurality of devices such as, for example, a monitoring device 156, a communication device 155, and the like. In various embodiments, the monitoring device 156 is not part of the HVAC system. For example, the monitoring device 156 is a server or computer of a third party such as, for example, a manufacturer, a support entity, a service provider, and the like. In other embodiments, the monitoring device 156 is located at an office of, for example, the manufacturer, the support entity, the service provider, and the like.

In various embodiments, the communication device 155 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In various embodiments, the communication device 155 includes at least one processor, memory and a user interface, such as a display. One skilled in the art will also understand that the communication device 155 disclosed herein includes other components that are typically included in such devices including, for example, a power supply, a communications interface, and the like.

The zone controller 180 is configured to manage movement of conditioned air to designated zones of the enclosed space 101. Each of the designated zones include at least one conditioning or demand unit such as, for example, the gas heat 120 and at least one user interface 170 such as, for example, the thermostat. The zone-controlled HVAC system 100 allows the user to independently control the temperature in the designated zones. In various embodiments, the zone controller 180 operates electronic dampers 185 to control air flow to the zones of the enclosed space 101.

In various embodiments, a data bus 190, which in the illustrated embodiment is a serial bus, couples various components of the HVAC system 100 together such that data is communicated therebetween. The data bus 190 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. The data bus 190 may include any number, type, or configuration of data buses 190, where appropriate. In particular embodiments, one or more data buses 190 (which may each include an address bus and a data bus) may couple the HVAC controller 150 to other components of the HVAC system 100. In other embodiments, connections between various components of the HVAC system 100 are wired. For example, conventional cable and contacts may be used to couple the HVAC controller 150 to the various components. In some embodiments, a wireless connection is employed to provide at least some of the connections between components of the HVAC system such as, for example, a connection between the HVAC controller 150 and the circulation fan 110 or the plurality of environment sensors 160.

Figure 2:
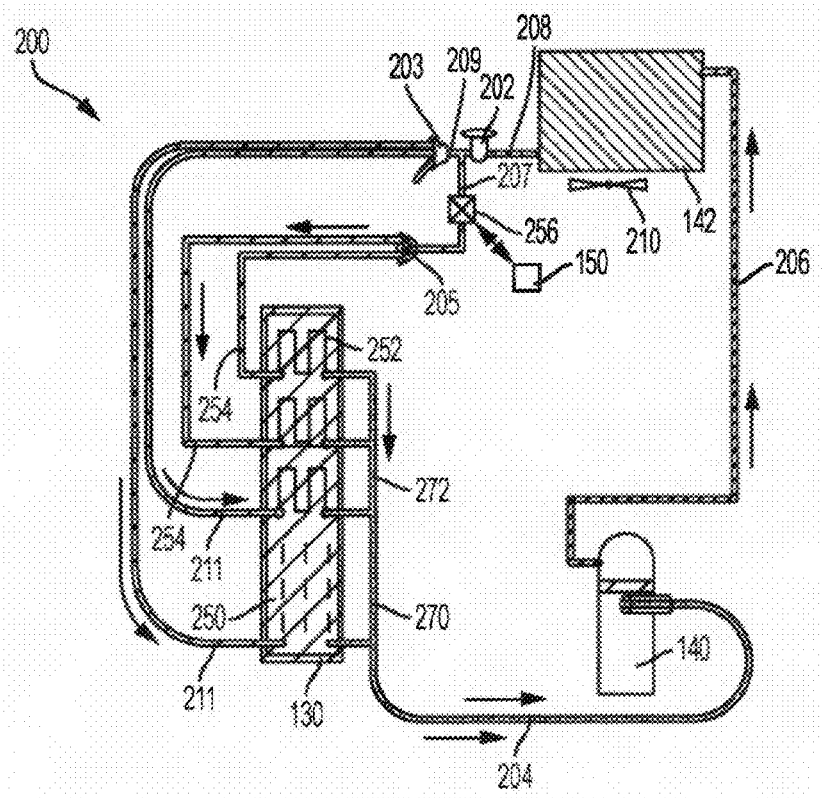
FIG. 2 is a schematic diagram on an exemplary HVAC system with a segmented evaporator coil and a second distributor operating in cooling mode.

FIG. 2 is a schematic diagram of an exemplary HVAC system 200 with a segmented evaporator coil 130 and a plurality of distributors operating in a cooling mode. For purposes of discussion, FIG. 2 is described herein relative to FIG. 1. The HVAC system 200 includes the segmented evaporator coil 130, the condenser coil 142, the compressor 140, a metering device 202, a first distributor 203, and a second distributor 205. The segmented evaporator coil 130 includes a primary segment 250 and a secondary segment 252. In various embodiments, the metering device 202 is, for example, a thermostatic expansion valve or a throttling valve. The primary segment 250 and the secondary segment 252 of the segmented evaporator coil 130 are fluidly coupled to the compressor 140 via a suction line 204. The suction line 204 includes a first connection 270 fluidly coupled to the primary segment 250 and a second connection 272 fluidly coupled to the secondary segment 252. The compressor 140 is fluidly coupled to the condenser coil 142 via a discharge line 206. The condenser coil 142 is fluidly coupled to the metering device 202 via a liquid line 208. The first distributor 203 is fluidly coupled to the metering device 202 via a first evaporator intake line 209 and the second distributor 205 is fluidly coupled to the metering device 202 via a second evaporator intake line 207. The first distributor 203 divides refrigerant flow into a first plurality of evaporator circuit lines 211 and directs refrigerant to the primary segment 250 of the segmented evaporator coil 130. The second distributor 205 divides refrigerant flow into a second plurality of evaporator circuit lines 254 and directs refrigerant to the secondary segment 252 of the segmented evaporator coil 130. A valve 256 such as, for example, a solenoid valve, is disposed in the second evaporator intake line 207 and is operable to restrict flow of refrigerant through the second distributor 205. The valve 256 is electrically connected to the HVAC controller 150 and is configured to receive signals from the HVAC controller 150. In various embodiments, the valve 256 is connected to the HVAC controller 150 via a wired connection; however, in other embodiments, the valve 256 may be connected to the HVAC controller 150 via a wireless protocol.

Still referring to FIG. 2, during operation, low-pressure, low-temperature refrigerant is circulated through the primary segment 250 and the secondary segment 252 of the segmented evaporator coil 130. The refrigerant is initially in a liquid/vapor state. In various embodiments, the refrigerant is, for example, R-22, R-134a, R-410A, R-744, or any other suitable type of refrigerant. Air from within the enclosed space 101, which is typically warmer than the refrigerant, is circulated around the segmented evaporator coil 130 by the circulation fan 110. In various embodiments, the refrigerant begins to boil after absorbing heat from the air and changes state to a low-pressure, low-temperature, super-heated vapor refrigerant. Saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refers to a thermodynamic state where a liquid is cooled below the saturation temperature of the liquid.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant travels from the compressor 140 to the condenser coil 142 via the discharge line 206. Outside air is circulated around the condenser coil 142 by a condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure of the high-pressure, high-temperature, sub-cooled liquid refrigerant is abruptly reduced by, for example, regulating an amount of refrigerant that travels to the first distributor 203 and the second distributor 205. Abrupt reduction of the pressure of the high-pressure, high-temperature, sub-cooled liquid refrigerant causes sudden, rapid, evaporation of a portion of the high-pressure, high-temperature, sub-cooled liquid refrigerant, commonly known as flash evaporation. The flash evaporation lowers the temperature of the resulting liquid/vapor refrigerant mixture to a temperature lower than a temperature of the air in the enclosed space 101. The liquid/vapor refrigerant mixture leaves the metering device 202 and enters the first distributor 203 via the first evaporator intake line 209. The first distributor 203 divides refrigerant flow into the first plurality of evaporator circuit lines 211 and directs refrigerant to the primary segment 250 of the segmented evaporator coil 130. When operating in the cooling mode, the HVAC controller 150 signals the valve 256 to move to an open position so as to permit flow of refrigerant through the second evaporator intake line 207 to the second distributor 205. The second distributor 205 divides refrigerant flow into a second plurality of evaporator circuit lines 254 and directs refrigerant to the secondary segment 252 of the segmented evaporator coil 130.

Figure 3:
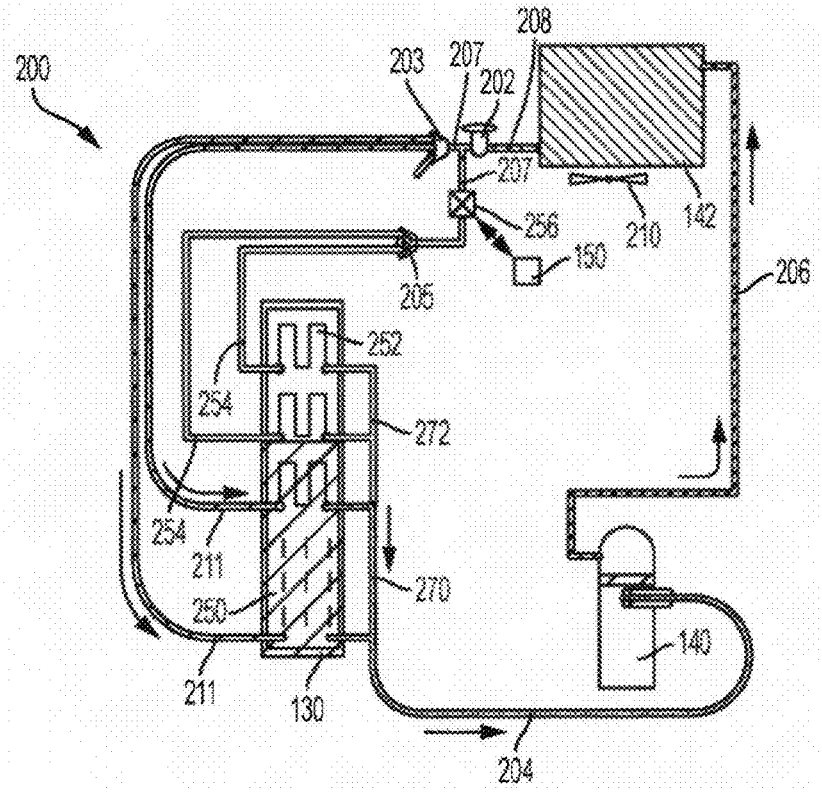
FIG. 3 is a schematic diagram of the exemplary HVAC system of FIG. 2 operating in dehumidification mode.

FIG. 3 is a schematic diagram of the exemplary HVAC system 200 of FIG. 2 operating in dehumidification mode. For purposes of discussion, FIG. 3 is described herein relative to FIGS. 1-2. During operation, low-pressure, low-temperature refrigerant is circulated through the primary segment 250 of the segmented evaporator coil 130. The refrigerant is initially in a liquid/vapor state. Air from within the enclosed space 101, which is typically warmer than the refrigerant, is circulated around the segmented evaporator coil 130 by the circulation fan 110. In various embodiments, the refrigerant begins to boil after absorbing heat from the air and changes state to a low-pressure, low-temperature, super-heated vapor refrigerant.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant travels from the compressor 140 to the condenser coil 142 via the discharge line 206. Outside air is circulated around the condenser coil 142 by the condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure and temperature of the high-pressure, high-temperature, sub-cooled liquid refrigerant is abruptly reduced resulting in flash evaporation of the refrigerant. Flash evaporation lowers the temperature of the resulting liquid/vapor refrigerant mixture to a temperature lower than a temperature of the air in the enclosed space 101. The liquid/vapor refrigerant mixture leaves the metering device 202 and enters the first distributor 203 via the first evaporator intake line 209. The first distributor 203 divides refrigerant flow into the first plurality of evaporator circuit lines 211 and directs refrigerant to the primary segment 250 of the segmented refrigerant evaporator coil 130. When operating in dehumidification mode, the HVAC controller 150 signals the valve 256 to move to a closed position. Thus, when operating in the dehumidification mode, no refrigerant flows through the second evaporator intake line 207 or the second distributor 205. In this manner, the secondary segment 252 of the segmented evaporator coil 130 is deactivated when operating in dehumidification mode.

Figure 4:
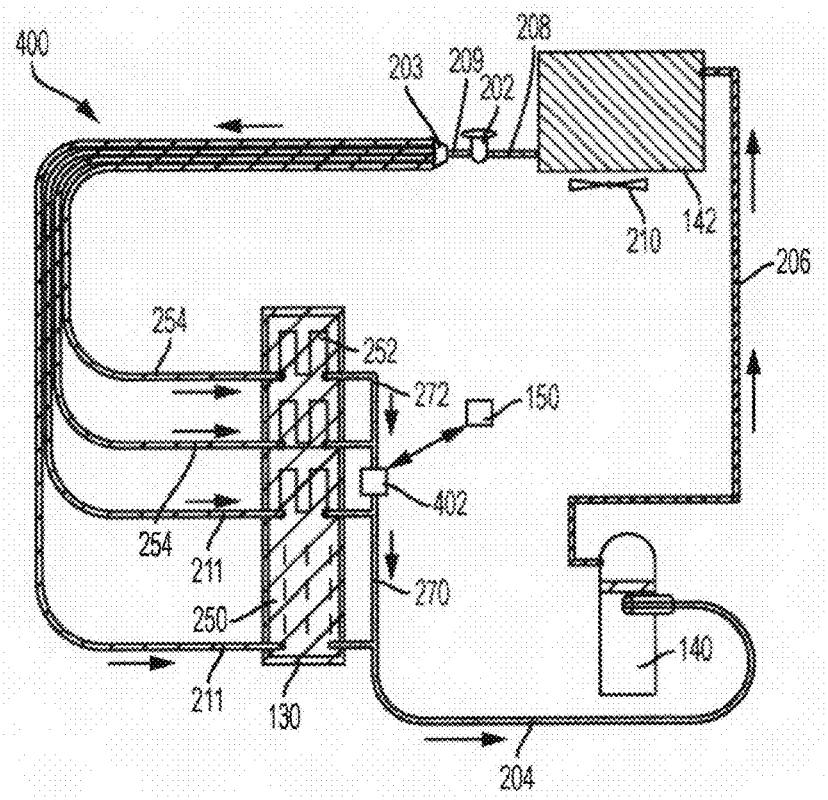
FIG. 4 is a schematic diagram of an exemplary HVAC system with a segmented evaporator coil operating in cooling mode.

FIG. 4 is a schematic diagram of an exemplary HVAC system 400 with the segmented evaporator coil 130 operating in cooling mode. For purposes of discussion, FIG. 4 is described herein relative to FIG. 1. The HVAC system 400 omits the second distributor 205 and the second evaporator intake line 207. Instead, the first distributor 203 divides refrigerant flow into the first plurality of evaporator circuit lines 211, fluidly coupled to the primary segment 250, and the second plurality of evaporator circuit lines 254, fluidly coupled to the secondary segment 252. The suction line 204 includes a first connection 270 fluidly coupled to the primary segment 250 and a second connection 272 fluidly coupled to the secondary segment 252. A valve 402 such as, for example, a solenoid valve, is disposed in the second connection 272 of the suction line 204. During operation, low-pressure, low-temperature refrigerant is circulated through the primary segment 250 of the segmented evaporator coil 130. The refrigerant is initially in a liquid/vapor state. In various embodiments, the refrigerant is, for example, R-22, R-134a, R-410A, R-744, or any other suitable type of refrigerant as dictated by design requirements. Air from within the enclosed space 101, which is typically warmer than the refrigerant, is circulated around the refrigerant evaporator coil 130 by the circulation fan 110.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant travels from the compressor 140 to the condenser coil 142 via the discharge line 206. Outside air is circulated around the condenser coil 142 by a condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure of the high-pressure, high-temperature, sub-cooled liquid refrigerant is abruptly reduced resulting in flash evaporation of the refrigerant. The flash evaporation lowers the temperature of the resulting liquid/vapor refrigerant mixture to a temperature lower than a temperature of the air in the enclosed space 101. The liquid/vapor refrigerant mixture leaves the metering device 202 and enters the first distributor 203 via the first evaporator intake line 209. The first distributor 203 divides refrigerant flow into the first plurality of evaporator circuit lines 211, fluidly coupled to the primary segment 250, and the second plurality of evaporator circuit lines 254, fluidly coupled to the secondary segment 252. The valve 402 is disposed in the second connection 272 of the suction line 204. When operating in the cooling mode, the HVAC controller 150 signals the valve 402 to move to the open position, thereby allowing flow of refrigerant through the secondary segment 252 of the segmented evaporator coil 130.

Figure 5:
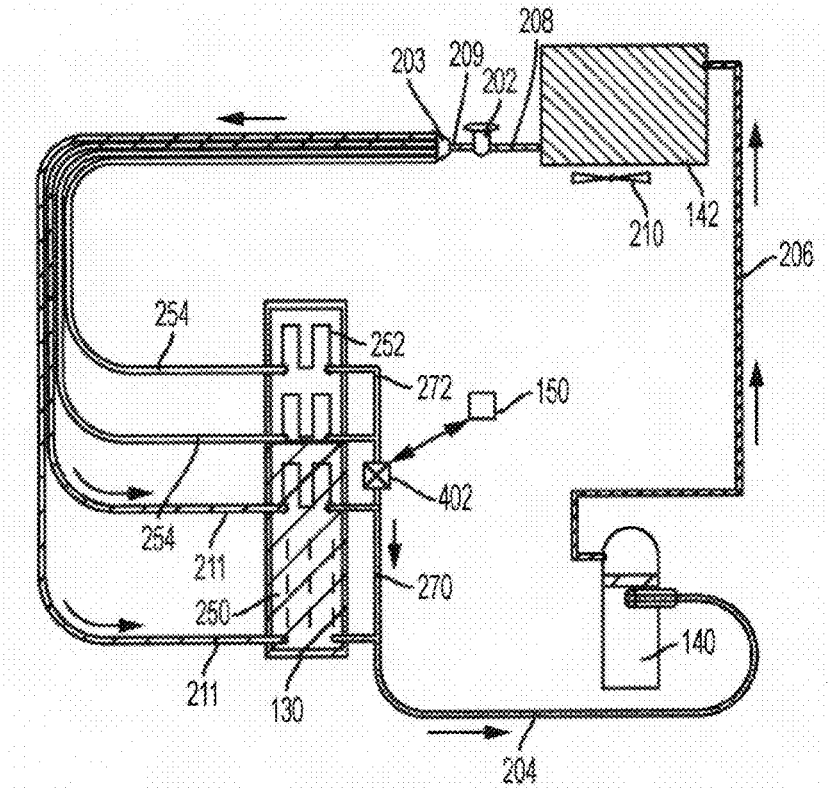
FIG. 5 is a schematic diagram of the exemplary HVAC system of FIG. 4 with a segmented evaporator coil operating in dehumidification mode.

FIG. 5 is a schematic diagram of the exemplary HVAC system 400 with a segmented evaporator coil 130 operating in dehumidification mode. For purposes of discussion, FIG. 5 is described herein relative to FIGS. 1 and 4. During operation, low-pressure, low-temperature refrigerant is circulated through the primary segment 250 of the segmented evaporator coil 130. The refrigerant is initially in a liquid/vapor state. Air from within the enclosed space 101, which is typically warmer than the refrigerant, is circulated around the refrigerant evaporator coil 130 by the circulation fan 110.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant travels from the compressor 140 to the condenser coil 142 via the discharge line 206. Outside air is circulated around the condenser coil 142 by a condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure of the high-pressure, high-temperature, sub-cooled liquid refrigerant is abruptly reduced resulting in flash evaporation of the refrigerant. The flash evaporation lowers the temperature of the resulting liquid/vapor refrigerant mixture to a temperature lower than a temperature of the air in the enclosed space 101. The liquid/vapor refrigerant mixture leaves the metering device 202 and enters the first distributor 203 via the first evaporator intake line 209. The first distributor 203 divides refrigerant flow into the first plurality of evaporator circuit lines 211, fluidly coupled to the primary segment 250, and the second plurality of evaporator circuit lines 254, fluidly coupled to the secondary segment 252. The valve 402 is disposed in the second connection 272 of the suction line 204. When operating in the dehumidification mode, the HVAC controller 150 signals the valve 402 to move to the closed position, thereby preventing flow of refrigerant through the secondary segment 252 of the segmented evaporator coil 130. In this manner, the secondary segment 252 of the segmented evaporator coil 130 is deactivated when operating in dehumidification mode.

Figure 6:
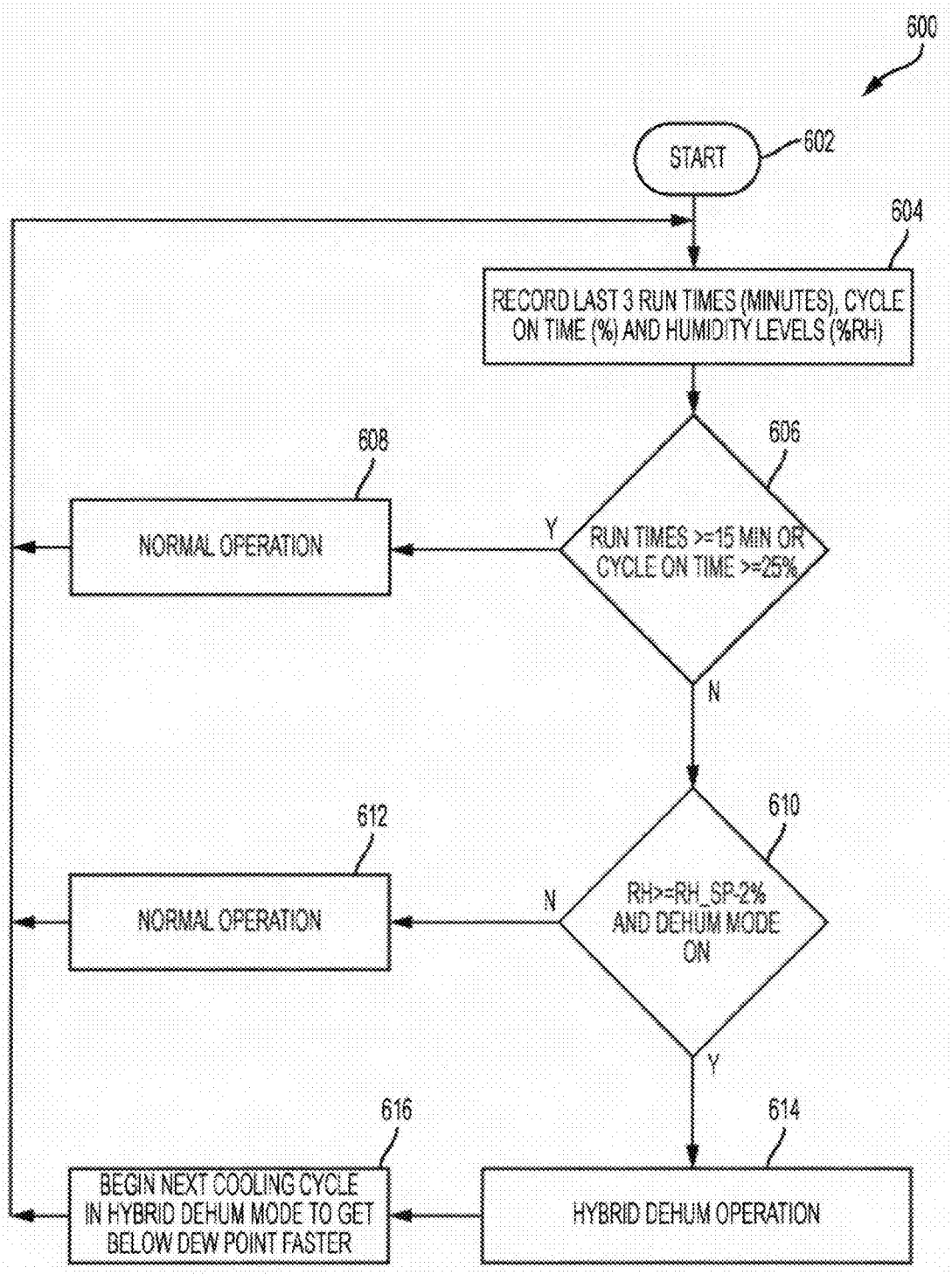
FIG. 6 is a flow diagram of a process controlling relative humidity of an enclosed space.

FIG. 6 is a flow diagram of a process 600 for controlling relative humidity of an enclosed space. For purposes of discussion, FIG. 6 is described herein relative to FIGS. 1-3. The process 600 is described herein relative to the HVAC system 200; however, one of skill in the art will recognize that the process 600 could also apply to the HVAC system 400. The process 600 beings at step 602 with the HVAC system operating in a cooling mode. At step 604, the HVAC controller 150 records an operational time associated with the previous three cycles of the HVAC system 200. In various embodiments, the operational time could be at least one of 1) the previous three run times (in minutes) of the HVAC system 200; and 2) a percentage of time that the HVAC system 200 is operational. Additionally, the HVAC controller 150 records relative humidity levels associated with the operational time. At step 606, the HVAC controller 150 determines if the operational time is greater than or equal to a pre-defined run time threshold. Responsive to a determination that the operational time is greater than or equal to the pre-defined run time threshold, the process 600 moves to step 608, where the HVAC system 200 continues operation in the cooling mode. Responsive to a determination that the operational time is less than the pre-defined run time threshold, the process 600 moves to step 610. At step 610, the HVAC controller 150 determines if the relative humidity of the enclosed space 101 is less than a predetermined set-point relative humidity. Responsive to a determination that the relative humidity of the enclosed space 101 is less than or equal to the predetermined set-point relative humidity, the process 600 moves to step 612, where the HVAC system 200 continues operation in the cooling mode. Responsive to a determination that the relative humidity of the enclosed space 101 is greater than or equal to the predetermined set-point relative humidity, the process 600 moves to step 614. At step 614, the HVAC controller 150 directs the HVAC system 200 to operate in a dehumidification mode. From step 614, the process 600 proceeds to step 616. At step 616, the HVAC controller 150 directs the HVAC system 200 to begin the next cooling cycle in the dehumidification mode.

Depending on the embodiment, certain acts, events, or functions of any of the algorithms, methods, or processes described herein can be performed in a different sequence, can be added, merged, or left out altogether (e.g., not all described acts or events are necessary for the practice of the algorithms, methods, or processes). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. An evaporator coil system, comprising:

a segmented evaporator coil comprising a primary segment and a secondary segment;

a suction line having a first connection fluidly coupled to the primary segment and a second connection fluidly coupled to the secondary segment;

a valve coupled to a controller and arranged on a discharge side of the segmented evaporator coil;

wherein the controller signals the valve to close, responsive to a determination that an operational time does not exceed a pre-defined run-time threshold and a relative humidity of an enclosed space exceeds a pre-defined set point relative humidity, thereby restricting flow of refrigerant through the secondary segment; and wherein the controller signals the valve to open, responsive to a determination that the operational time does not exceed the pre-defined run-time threshold and the relative humidity of the enclosed space does not exceed the pre-defined set point relative humidity, thereby permitting flow of refrigerant through the secondary segment.

2. The evaporator coil system of claim 1, comprising:

a first plurality of evaporator circuit lines fluidly coupled to the primary segment; and a second plurality of evaporator circuit lines fluidly coupled to the secondary segment.

3. The evaporator coil system of claim 1, wherein the valve restricts flow of refrigerant through the secondary segment responsive to a signal to operate in a dehumidification mode.

4. The evaporator coil system of claim 1, wherein responsive to a signal to operate in a dehumidification mode, the controller signals the valve to move to a closed position to restrict flow of refrigerant through the secondary segment.

5. The evaporator coil system of claim 1, wherein the valve permits flow of refrigerant through the secondary segment responsive to a signal to operate in a cooling mode.

6. The evaporator coil system of claim 1, wherein responsive to a signal to operate in a cooling mode, the controller signals the valve to move to an open position to allow flow of refrigerant through the secondary segment.

7. The evaporator coil system of claim 2, comprising a distributor fluidly coupled to the first plurality of evaporator circuit lines and fluidly coupled to the second plurality of evaporator circuit lines.

8. An evaporator coil system, comprising:

a segmented evaporator coil comprising a primary segment and a secondary segment;

a suction line having a first connection fluidly coupled to the primary segment and a second connection fluidly coupled to the secondary segment;

a valve electrically coupled to a controller;

wherein responsive to a signal to operate in a dehumidification mode, a controller signals the valve to move to a closed position to restrict flow of refrigerant through the secondary segment responsive to a determination that an operational time does not exceed a pre-defined run-time threshold and a relative humidity of an enclosed space exceeds a pre-defined set point relative humidity; and wherein responsive to a signal to operate in a cooling mode, the controller signals the valve to move to an open position to allow flow of refrigerant through the secondary segment responsive to a determination that the operational time does not exceed the pre-defined run-time threshold and the relative humidity of the enclosed space does not exceed the pre-defined set point relative humidity.

9. The evaporator coil system of claim 8, wherein the valve is in fluid communication with the secondary segment so as to selectively restrict refrigerant flow through the secondary segment while allowing flow of refrigerant through the primary segment.

10. The evaporator coil system of claim 8, wherein the valve is arranged on a discharge side of the segmented evaporator coil.

11. The evaporator coil system of claim 8, wherein the valve comprises a solenoid valve.

12. The evaporator coil system of claim 8, comprising:

a first plurality of evaporator circuit lines fluidly coupled to the primary segment; and a second plurality of evaporator circuit lines fluidly coupled to the secondary segment.

13. An evaporator coil system, comprising:

a segmented evaporator coil comprising a primary segment and a secondary segment;

a suction line having a first connection fluidly coupled to the primary segment and a second connection fluidly coupled to the secondary segment;

a valve arranged in the second connection downstream of the secondary segment and parallel to the primary segment;

a controller electrically coupled to the valve;

wherein the controller is configured to:

measure an operational time of the HVAC system;

determine if the operational time exceeds a pre-defined run-time threshold;

responsive to a determination that the operational time is less than the pre-defined run-time threshold, determine if a relative humidity of an enclosed space exceeds a pre-defined set point relative humidity;

responsive to a determination that the operational time exceeds the pre-defined run-time threshold and the relative humidity of the enclosed space does not exceed the pre-defined set point relative humidity, signal the valve to close thereby restricting flow of refrigerant through the secondary segment; and responsive to a determination that the operational time does not exceed the pre-defined run-time threshold and the relative humidity of the enclosed space does not exceed the pre-defined set point relative humidity, signal the valve to open thereby permitting flow of refrigerant through the secondary segment.

14. The evaporator coil system of claim 13, wherein the operational time is run time in minutes.

15. The evaporator coil system of claim 13, wherein the operational time is a percentage of time that the HVAC system is operational.

16. The evaporator coil system of claim 13, wherein the controller is configured to:

responsive to a determination that the operational time exceeds the pre-defined run-time threshold and the relative humidity of the enclosed space exceeds the pre-defined set point relative humidity, direct a subsequent cooling cycle to begin in dehumidification mode.

* * * * *